US006884151B2

(12) United States Patent
Sakai et al.

(10) Patent No.: US 6,884,151 B2
(45) Date of Patent: Apr. 26, 2005

(54) METHOD AND APPARATUS FOR FORMING GROOVES ON A WORKPIECE AND FOR DRESSING A GRINDSTONE USED IN THE GROOVE FORMATION

(75) Inventors: Akio Sakai, Maebashi (JP); Takaji Iwasawa, Maebashi (JP); Katsuyuki Yamamoto, Hanyu (JP); Hiroyuki Ikeda, Hanyu (JP); Masami Tanaka, Hanyu (JP)

(73) Assignee: NSK Ltd., Tokyo (JP)

( * ) Notice: Subject to any disclaimer, the term of this patent is extended or adjusted under 35 U.S.C. 154(b) by 0 days.

(21) Appl. No.: 10/857,691

(22) Filed: May 28, 2004

(65) Prior Publication Data

US 2004/0219866 A1 Nov. 4, 2004

Related U.S. Application Data

(62) Division of application No. 10/403,973, filed on Mar. 28, 2003, now Pat. No. 6,783,428, which is a division of application No. 10/047,190, filed on Oct. 25, 2001, now Pat. No. 6,572,442, which is a division of application No. 09/483,495, filed on Jan. 14, 2000, now Pat. No. 6,361,410.

(30) Foreign Application Priority Data

| | | |
|---|---|---|
| Jan. 18, 1999 | (JP) | 11-009400 |
| Nov. 12, 1999 | (JP) | 11-322463 |
| Nov. 19, 1999 | (JP) | 11-329920 |

(51) Int. Cl.[7] ..... B24B 53/53

(52) U.S. Cl. ..... 451/8; 125/11.01; 125/11.03; 451/56; 451/57

(58) Field of Search ..... 451/5, 41, 56, 451/57; 125/11.01, 11.03, 11.18; 51/165.71, 165.88, 165.87

(56) References Cited

U.S. PATENT DOCUMENTS

| | | | | |
|---|---|---|---|---|
| 4,051,830 | A | | 10/1977 | Gruber |
| 4,151,684 | A | * | 5/1979 | Wada et al. ..... 451/21 |
| 4,219,972 | A | | 9/1980 | Ota et al. |
| 4,456,303 | A | | 6/1984 | Due |
| 4,658,800 | A | | 4/1987 | Larsson |
| 4,866,887 | A | * | 9/1989 | Imai et al. ..... 451/5 |
| 4,899,718 | A | * | 2/1990 | Usutani et al. ..... 125/11.06 |
| 4,924,842 | A | * | 5/1990 | Rao et al. ..... 125/11.01 |
| 4,953,522 | A | * | 9/1990 | Vetter ..... 125/11.01 |
| 5,006,685 | A | * | 4/1991 | Hatano et al. ..... 219/69.2 |
| 5,127,391 | A | | 7/1992 | O'Keefe |

(Continued)

FOREIGN PATENT DOCUMENTS

| | | |
|---|---|---|
| JP | 61-169564 | 10/1986 |
| JP | 3-19770 | 1/1991 |
| JP | 5-131372 | 5/1993 |
| JP | 6-8138 | 1/1994 |

*Primary Examiner*—Lee D. Wilson
*Assistant Examiner*—Anthony Ojini
(74) *Attorney, Agent, or Firm*—Christensen O'Connor Johnson Kindness PLLC

(57) ABSTRACT

A grinding apparatus for grinding a spline ball groove on a workpiece comprises a rod-shaped grindstone, having a distal end portion with a curved surface corresponding to the groove to be ground, and a spindle mechanism for rotating the grindstone. The spindle mechanism and the grindstone are supported by means of a supporter in a manner such that they are inclined at a given angle to an axis of the workpiece. A rotary dresser, which has a dress groove corresponding to the curved surface of the distal end portion of the grindstones is disposed near the grinding apparatus. The grindstone can be reciprocated along the axis of the workpiece by a drive mechanism between the workpiece and the dresser without changing its angle of inclination.

3 Claims, 8 Drawing Sheets

U.S. PATENT DOCUMENTS

| | | | |
|---|---|---|---|
| 5,139,005 | A | 8/1992 | Dodd |
| 5,183,026 | A | 2/1993 | Ohta et al. |
| 5,209,020 | A | 5/1993 | Feisel |
| 5,272,843 | A | 12/1993 | Maruyama et al. |
| 5,441,449 | A | 8/1995 | Hart |
| 5,582,536 | A | 12/1996 | Kagamida |
| 5,620,358 | A | 4/1997 | Furukawa et al. |
| 5,681,209 | A | 10/1997 | Naumann et al. |
| 5,738,569 | A | 4/1998 | Mackowsky |
| 5,904,608 | A | 5/1999 | Watanabe |
| 6,123,605 | A | 9/2000 | Yano |
| 6,290,574 | B1 | 9/2001 | Thyssen |

* cited by examiner

METHOD AND APPARATUS FOR FORMING GROOVES ON A WORKPIECE AND FOR DRESSING A GRINDSTONE USED IN THE GROOVE FORMATION

CROSS-REFERENCES TO RELATED APPLICATIONS

This is a division of U.S. patent application Ser. No. 10/403,973, filed Mar. 28, 2003 now U.S. Pat. No. 6,783,428, which is a division of U.S. patent application Ser. No. 10/047,190, filed Oct. 25, 2001 (now U.S. Pat. No. 6,572,442), which is a division of U.S. patent application Ser. No. 09/483,495, filed Jan. 14, 2000 (now U.S. Pat. No. 6,361,410), the benefit of the filing dates of which is hereby claimed under 35 U.S.C. § 120.

BACKGROUND OF THE INVENTION

The present invention relates to a grinding apparatus provided with a grindstone for working, for example, spline ball grooves on the inner surface of a workpiece and a dressing method for dressing the grindstone.

There are known grinding apparatuses that use a grindstone to form spline ball grooves on the inner surface of a workpiece. One such conventional grinding apparatus comprises a spindle mechanism, which is rotated by means of a motor, and a substantially disc-shaped grindstone rotatable by means of the spindle mechanism. As the grindstone rotates and moves in the axial direction of the workpiece, its outer peripheral portion grinds the inner surface of the workpiece. The grindstone is rotatably supported by means of a bearing of the spindle mechanism. A pulley is coupled to the grindstone. Another pulley is coupled to the rotating shaft of the motor that is situated at a distance from the grindstone. An endless belt for power transmission is passed around and between the two pulleys.

The rotation of the motor is transmitted to the grindstone by means of the pulleys and the belt. The axis of the spindle mechanism extends parallel to that of the workpiece. The spline ball grooves are ground as the grindstone rotates and moves parallel to the axis of the workpiece so that its outer peripheral portion touches the inner surface of the workpiece. This conventional grinding apparatus cannot use a bearing that has a diameter larger than that of the disc-shaped grindstone. Accordingly, the bearing cannot enjoy good stiffness to resist grinding force.

Thus, according to the conventional grinding apparatus described above, it is hard to augment grinding forces in the tangential and normal directions of the circular grindstone that are needed to grind the workpiece. In some cases, therefore, the grinding efficiency is low, and the surface accuracy of the spline ball grooves is not high enough. Since the bearing has a small diameter, moreover, it is subjected to too heavy a load of grinding to enjoy a long life. Since the belt is small-sized, furthermore, its tension or durability may be unsatisfactory.

As shown in FIG. 13, some conventional grinding apparatuses may use a single-point dresser 101 for dressing a grindstone 100. According to a dressing method using this dresser 101, however, it is ground at an angle θ' to a center 100*c* of the grindstone 100 (so-called interference grinding), so that a distal end face 102 of the grindstone 100 cannot easily have a given curvature radius and is subject to undulation. Further, it is hard for the dresser 101 accurately to dress and shape a grindstone for grinding a groove in the form of a Gothic arch.

FIG. 14 shows shape errors of a Gothic-arched groove ground with use of the grindstone 100 that is dressed by means of the conventional dresser 101. A target value of a curvature radius R of the groove for a contact angle θ of 45° is 3 mm. In this case, the target value can be substantially secured for positions near 45° (θ=40° to 50°). At its bottom or shoulder portions, however, the groove is subject to considerable shape errors, as indicated by a segment 103.

In the case where a formed dresser is used for dressing, on the other hand, the grindstone may possibly fail to come into entire contact with the dresser, owing to thermal deformation of the spindle mechanism for the grindstone or a dresser rotating mechanism. Conventionally, this problem is solved by a known technique that is described in Jpn. Pat. Appln. KOKAI Publication No. 3-19770, for example. This technique is a method in which the axial displacement of a grindstone is detected by means of a noncontact sensor, and dressing is carried out after dislocation corresponding to the displacement is corrected. Although this conventional technique can be effectively applied to a small-diameter grindstone for inner surface grinding, it cannot be used to dress a large-diameter grindstone for outer surface grinding or a pencil-type grindstone.

In Jpn. UM Appln. KOKAI Publication No. 61-169564, there is described an apparatus for transmitting ultrasonic vibration, which is generated as a rotary dresser and a grindstone come into contact with each other, to an acoustic emission sensor through the medium of a liquid, in order to detect contact between the dresser and the grindstone. In this conventional apparatus, however, the liquid for use as the ultrasonic propagation medium cannot be controlled with ease. Described in Jpn. Pat. Appln. KOKAI Publication No. 6-8138, moreover, is an apparatus in which contact between a grindstone and a rotary dresser is detected by means of a sensor with the aid of a ball that is attached to the dresser. In this conventional apparatus, however, the ball generates noise of a relatively high level as it touches a detection plate. In the case where processing requires use of infinitesimal contact signals, the signal-to-noise ratio is limited and unpractical.

BRIEF SUMMARY OF THE INVENTION

Accordingly, a first object of the present invention is to provide a grinding apparatus capable of grinding grooves on a workpiece with improved efficiency. A second object of the invention is to provide a grinding apparatus capable of enhancing the accuracy of a grindstone to improve the accuracy of work on grooves. A third object of the invention is to provide a dressing method in which the whole surface of a grindstone can be brought securely into contact with a dresser, so that the dressing accuracy is improved to lengthen the life of the grindstone and enhance the dressing efficiency.

In order to achieve the first object described above, a grinding apparatus according to the present invention comprises a rod-shaped grindstone having a distal end portion with a curved surface corresponding to the cross section of a groove of a workpiece to be ground, a spindle mechanism for rotating the grindstone, supporting means for supporting the grindstone in a manner such that the grindstone is inclined at a given angle to the axis of the workpiece fixed in a predetermined position, and a drive mechanism for bringing the distal end portion of the grindstone into contact with the workpiece and relatively moving the grindstone along the axis of the workpiece without changing the aforesaid angle to the workpiece.

According to this invention, the grindstone has increased stiffness to resist grinding force as it forms a spline ball groove on the inner surface of the workpiece, so that the grinding efficiency and worked groove accuracy are improved. In this invention, the grindstone includes a rod-shaped metallic support member, an inner grindstone layer portion attached to the outer periphery of the support member, and an outer grindstone layer portion fixed to the inner grindstone layer portion so as to cover the outer peripheral surface thereof and having a distal end portion with a curved surface corresponding to the cross section of the spline ball groove of the workpiece. According to this invention, the grindstone and components of its drive system are improved in durability.

In order to achieve the second object, a grinding apparatus according to the invention comprises a rod-shaped grindstone having a distal end portion with a curved surface corresponding to the cross section of a groove of a workpiece to be ground, a spindle mechanism for rotating the grindstone, supporting means for supporting the grindstone in a manner such that the grindstone is inclined at a given angle to the axis of the workpiece fixed in a predetermined position, a dressing apparatus including a rotary dresser having a dress groove with a cross section corresponding to the distal end portion of the grindstone, and a drive mechanism for relatively moving the grindstone along the axis of the workpiece without changing the aforesaid angle, thereby reciprocating the distal end portion of the grindstone between the dress groove and the workpiece.

According to this invention, the rod-shaped grindstone reciprocates between the worked groove of the workpiece and the dress groove, whereby the distal end portion of the grindstone can be shaped every time the groove is worked. In this grinding apparatus, the shape of the groove of the formed dresser is given to the grindstone as the grindstone is dressed, so that the distal end portion of the grindstone can be shaped so as to enjoy an accurate curvature radius. Accordingly, the grindstone can work the groove of the workpiece with high accuracy without rendering the inner surface of the groove undulatory. Thus, the grinding apparatus can accurately work a groove having the shape of a Gothic arch, not to mention a groove with a single curvature radius.

A dressing apparatus according to this invention should comprise a movable supporter, a moving mechanism for moving the supporter, a rotating mechanism mounted on the supporter, a rotary dresser rotatable by means of the rotating mechanism, an AE sensor attached to the rotary dresser and adapted to detect vibration generated when the dresser is brought into contact with the grindstone and to deliver an output based on the vibration, a receiver attached to the supporter in a manner such that the receiver is opposed to the AE sensor across an air gap and capable of receiving the output of the AE sensor, and a controller adapted to deliver a command to stop the movement of the supporter in response to a signal received by the receiver.

According to this invention, the contact between the rod-shaped grindstone and the dresser can be highly accurately detected as the grindstone is dressed.

In order to achieve the third object, a dressing method according to the invention comprises a first positioning process for relatively moving a grindstone in a first direction along the axis of a rotary dresser from a position in which the grindstone faces an inner surface of a dress groove, detecting a first contact position reached the moment the grindstone touches one side edge of the dress groove, and stopping the movement, a second positioning process for relatively moving the grindstone in a second direction along the aforesaid axis, detecting a second contact position reached the moment the grindstone touches the other side edge of the dress groove, and stopping the movement, the second positioning process directly following the first positioning process, a third positioning process for moving the grindstone to an intermediate position between the first and second contact positions, and a dressing process for moving the grindstone toward the inner surface of the dress groove in a direction perpendicular to the axis, thereby bringing a distal end portion of the grindstone into contact with the inner surface of the dress groove, the dressing process directly following the third positioning process.

According to this invention, the whole surface of the grindstone can be brought into contact with the formed dresser in one cycle of the dressing process without being influenced by thermal deformation of a spindle mechanism for the grindstone or a dresser rotating mechanism. According to this dressing method, the dressing accuracy is improved, so that the grindstone can be shaped with a minor bite of dressing. Since the grindstone can be kept from partial dressing, moreover, its life is prolonged, the grinding efficiency is improved, and the groove can be worked with high accuracy.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Figure 1:
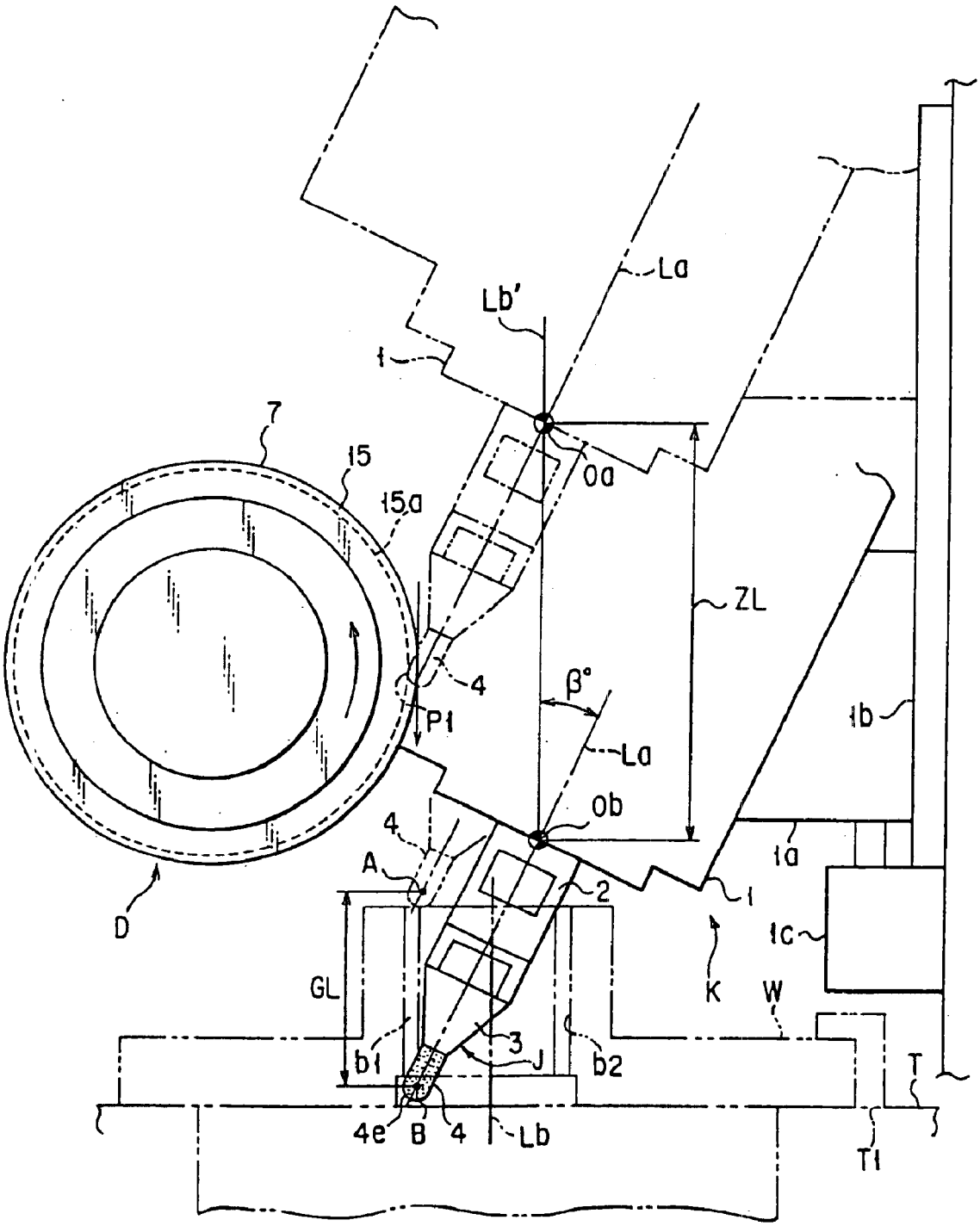
FIG. 1 is a side view of a grinding apparatus according to a first embodiment of the present invention.
Figure 4A:
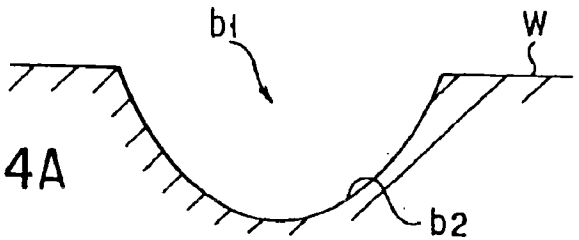
FIG. 4A is a sectional view of a groove worked by means of the grinding apparatus of FIG. 1.

A first embodiment of the present invention will now be described with reference to the accompanying drawings of FIGS. 1 to 7C. Referring first to FIG. 1, there are shown a grinding apparatus K, which includes a grindstone 4, and a dressing apparatus D, which includes a rotary dresser 7. The grindstone 4 of the grinding apparatus K is used to form spline ball grooves b1 along an axis Lb of a workpiece W on the inner peripheral surface of the workpiece W. The cross section of a bottom b2 of each spline ball groove b1 has the shape of a Gothic arch, as shown in FIG. 4A, or a semicircle with a given curvature radius, for example. The workpiece w is placed in a pre determined position on a turntable T and fixed by means of a chuck mechanism T1. Every time the grindstone 4 of the grinding apparatus K grinds one groove b1, the turntable T is rotated for a given angle to reach the position for the next groove to be worked. In FIG. 1, the axis Lb of the workpiece W extends in the vertical direction. When the workpiece W is used after it is completed, balls (not shown) are held in the spline ball grooves b1 for rolling motion.

The grinding apparatus K is provided with a spindle mechanism 1 that contains a motor therein. A first grindstone holder 2 is mounted on the output shaft of the spindle mechanism 1. A second grindstone holder 3 is coupled to the first grindstone holder 2. The rod-shaped grindstone 4 is attached to the distal end of the second grindstone holder 3.

The spindle mechanism 1, grindstone holders 2 and 3, and grindstone 4 are situated on a common axis La. The spindle mechanism 1 is supported by means of a supporter 1*a* in a manner such that its axis La is inclined at a given angle β to the axis Lb of the workpiece W. The supporter 1*a* can be moved up and down by means of the drive mechanism 1*c* along a guide 1*b* that extends over the turntable T. Thus, the spindle mechanism 1 and the grindstone 4 can move for a distance ZL between a top dead center Oa and a bottom dead center Ob shown in FIG. 1 along the axis Lb of the workpiece W.

When the spindle mechanism 1 reaches the top dead center Oa, a distal end portion 4*e* of the grindstone 4 is situated in a predetermined dress position P1 on the dressing apparatu125s D. When the spindle mechanism 1 is moved to the bottom dead center Ob, the distal end portion 4*e* of the grindstone 4 is situated in a grinding end position B in one of the grooves b1. A grinding start positions A in the groove b1 is situated between the dress position P1 and the grinding end position B. A grinding stroke GL of the grindstone 4 is equal to the distance from the grinding start position A to the grinding end position B.

The second grindstone holder 3, which is fitted with the grindstone 4, and the first grindstone holder 2 coupled to the holder 3 are inserted toward the grinding end position B in the workpiece W in a manner such that they are kept inclined at the given angle β to the axis Lb of the workpiece W. The angle β is adjusted to a value such that the grindstone holders 2 and 3 are not in contact with the inner surface of the workpiece W when the grindstone 4 is inserted into the workpiece W.

Figure 3:
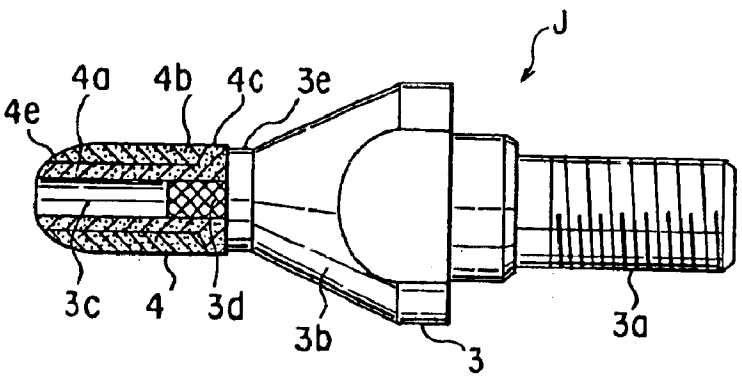
FIG. 3 is a sectional view of a grindstone used in the grinding apparatus of FIG. 1.

FIG. 3 shows a grindstone assembly J. The grindstone assembly J includes the second grindstone holder 3, which is formed of a metal rod, and the grindstone 4 fixed to the holder 3. The grindstone holder 3 functions as a support member for supporting the grindstone 4. An external thread portion 3*a* is provided on one end of the second grindstone holder 3. The external thread portion 3*a* can be screwed into an internal thread portion (not shown) of the first grindstone holder 2. The grindstone holder 3 has a taper portion 3*b* of which the outside diameter is reduced toward the grindstone 4. The distal end of holder 3 is formed having a straight portion 3*c* that has a diameter smaller than that of a distal end portion 3*e* of the taper portion 3*b*. A knurled rough surface 3*d* is formed on the outer peripheral surface of the straight portion 3*c*.

The grindstone 4 is composed of an inner grindstone layer portion 4*a* and an outer grindstone layer portion 4*b* that have different properties. A collar portion 4*c* is formed on the proximal end of the cylindrical inner grindstone layer portion 4*a*. The outside diameter of the collar portion 4*c* is substantially equal to that of the distal end portion 3*e* of the taper portion 3*b*. The inside diameter of the cylindrical outer grindstone layer portion 4*b* is substantially equal to the outside diameter of the inner grindstone layer portion 4*a*. The outer diameter of the outer layer portion 4*b* is equal to the outside diameter of the collar portion 4*c* of the inner layer portion 4*a*. The inner grindstone layer portion 4*a* is fitted onto the straight portion 3*c* so that the collar portion 4*c* abuts against the distal end portion 3*e* of the taper portion 3*b*. The inner grindstone layer portion 4*a* is fixed to the straight portion 3*c* and the distal end portion 3*e* with an adhesive agent. The rough surface 3*d* of the straight portion 3*c* serves to enhance the fixing strength of the inner grindstone layer portion 4*a* on the straight portion 3*c*. The inner and outer grindstone layer portions 4*a* and 4*b*, united in this manner, constitute the grindstone 4 in the form of a round rod.

Each of the respective distal end portions 4*e* of the inner and outer grindstone layer portions 4*a* and 4*b* has a curved surface with a given curvature radius. Since the grindstone 4 is attached to grinding apparatus K at the aforesaid angle β, the spline ball grooves b1 can be ground on the inner peripheral surface of the workpiece W by means of the distal end portion 4*e* of the grindstone 4.

Figure 5:
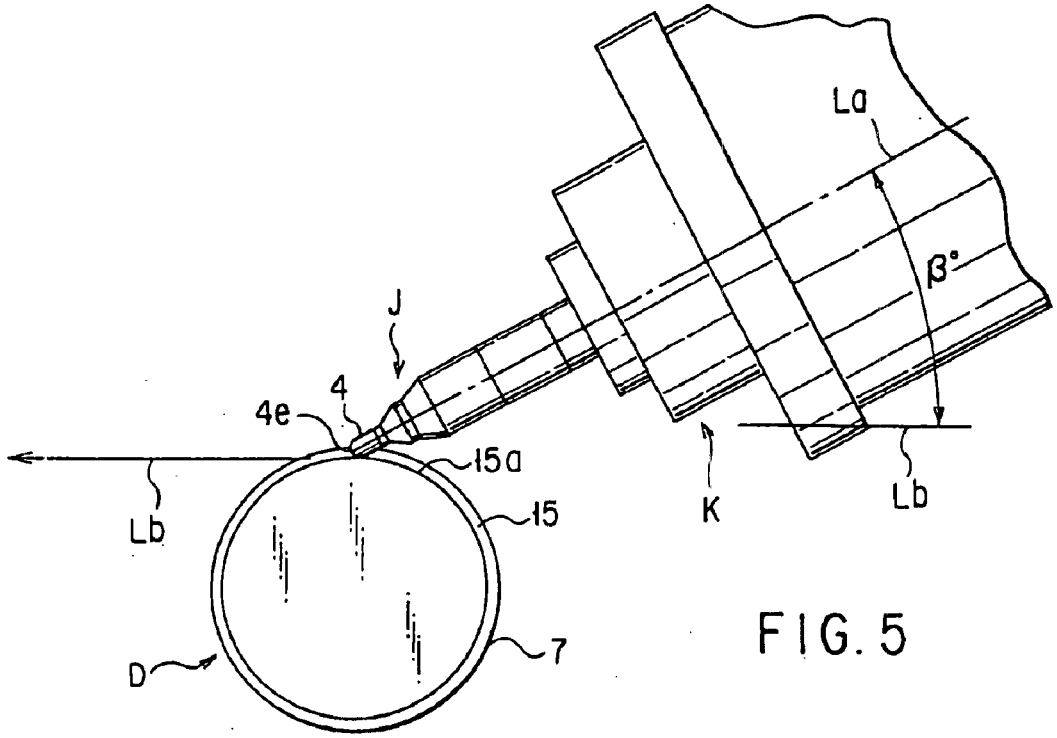
FIG. 5 is a side view showing a part of the grinding apparatus of FIG. 1 and a part of a dressing apparatus.
Figure 6:
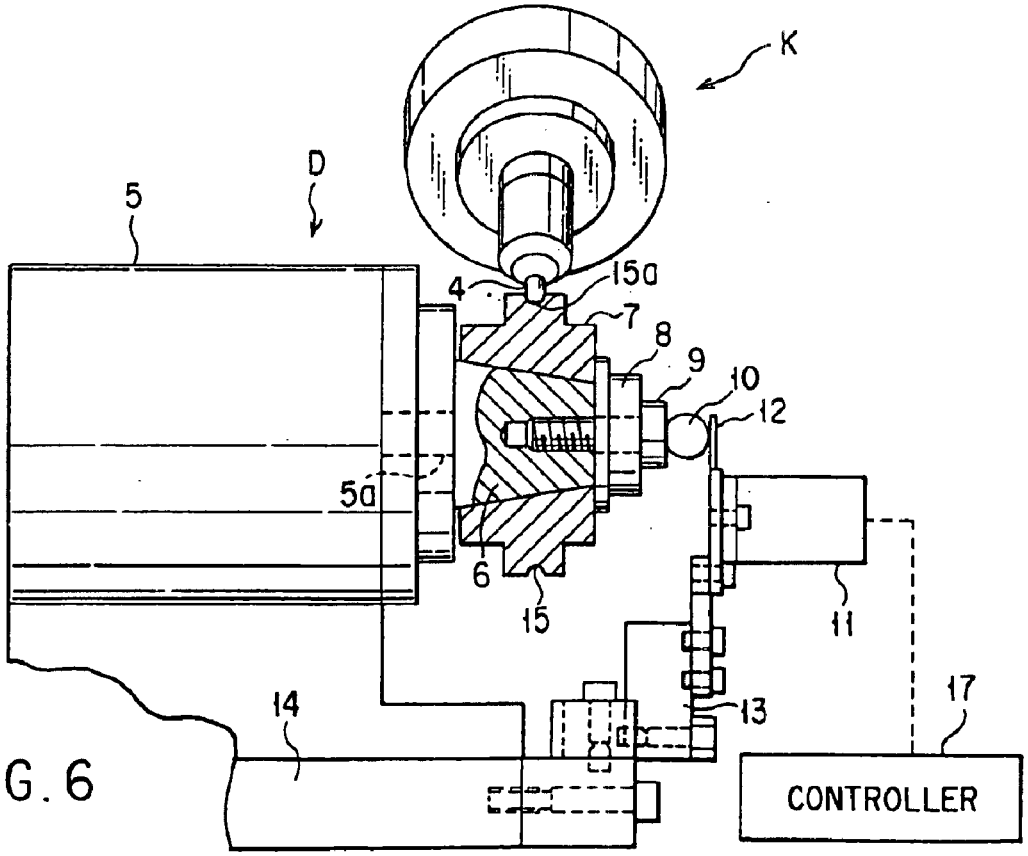
FIG. 6 is a front view, partially in section, showing the dressing apparatus of FIG. 1.

As shown in FIGS. 5 and 6, the dressing apparatus D comprises a rotating mechanism 5 having a motor therein, a tapered body 6 attached to an output shaft 5*a* of the mechanism 5, a rotary dresser 7 fitted on the tapered body 6, etc. The rotary dresser 7 is fixed to the tapered body 6 by means of a collar 8 and a bolt 9.

A ball 10 is attached to the distal end of the bolt 9. An acoustic emission sensor (hereinafter referred to as AE sensor) 11 is disposed beside the ball 10. The AE sensor 11 is provided with a plate spring 12, which serves as a contact member for propagating vibration. The spring 12 is in contact with the distal end of the ball 10. The sensor 11 is attached to the bracket 13. The bracket 13 is mounted on a table 14 that is movable together with the rotating mechanism 5. The AE sensor 11 is connected electrically to a controller 17.

A dress groove 15 having an arcuate cross section is formed on the outer peripheral surface of the rotary dresser 7 so as to be continuous in the circumferential direction thereof. The grindstone 4 is dressed as its distal end portion 4*e* is held against an inner surface 15*a* of the dress groove 15 in the manner mentioned later. During dressing operation, the axis La of the grindstone 4 is also inclined at the angle β to the tangential direction of the rotary dresser 7 (direction of the axis Lb of the workpiece W), as shown in FIG. 5.

The following is a description of processes for forming the spline ball grooves, b1 on the workpiece W by means of the grinding apparatus K.

As shown in FIG. 1, the axis La of the spindle mechanism 1 and the grindstone 4 are inclined at the angle β to the axis Lb of the workpiece. The mechanism 1 and the grindstone 4 are vertically moved along a segment Lb' parallel to the axis Lb of the workpiece w by means of the drive mechanism 1*c*. The position of the grindstone 4 relative to the rotary dresser 7 is previously adjusted so that the grindstone 4 can start movement at the dress position P1.

When the grindstone 4, having started to move down from the dress position P1, reaches the grinding start position A, its distal end portion 4*e* abuts against the inner surface of the workpiece W. Grinding the spline ball grooves b1 is started at the grinding start position A. The grooves b1 are ground as the grindstone 4, kept inclined at the angle β, is moved along the axis Lb of the workpiece W to the grinding end position B. These are main grinding processes.

After the grindstone 4 reaches the grinding end position B, the spindle mechanism 1 is raised to the dress position P1 by means of the drive mechanism 1*c*. While this is done, the grindstone 4 is also kept inclined at the angle β, and the distal end portion 4*e* of the grindstone 4 rises along the spline ball grooves b1, so that the grooves b1 can be ground more securely. In these grinding processes, the spline ball grooves b1, each having a cross section in the shape of a Gothic arch or a circular arc with a single curvature radius, are formed on the inner surface of the workpiece W, as shown in FIG. 4A. The grinding apparatus K, which grinds the workpiece w with its rod-shaped grindstone 4 inclined with respect to the inner surface of the workpiece W, has high stiffness to resist reaction force from the workpiece W. Therefore, the grinding apparatus K can efficiently grind grooves b1 in a relatively short period of time.

When the grindstone 4 returns to the dress position P1, its distal end portion 4*e* comes into contact with the inner surface 15*a* of the dress groove 15 of the rotary dresser 7, whereupon it is dressed. As this is done, the angle β of inclination of the grindstone 4 can be also maintained. In this manner, the grindstone 4 is shaped by means of the dresser 7 every time one groove b1 is formed on the workpiece W. Thus, the distal end portion 4*e* of the grindstone 4 can always maintain very high shape accuracy and grinding efficiency, so that the surface accuracy of the groove bottom b2 can be kept high.

Figure 2:
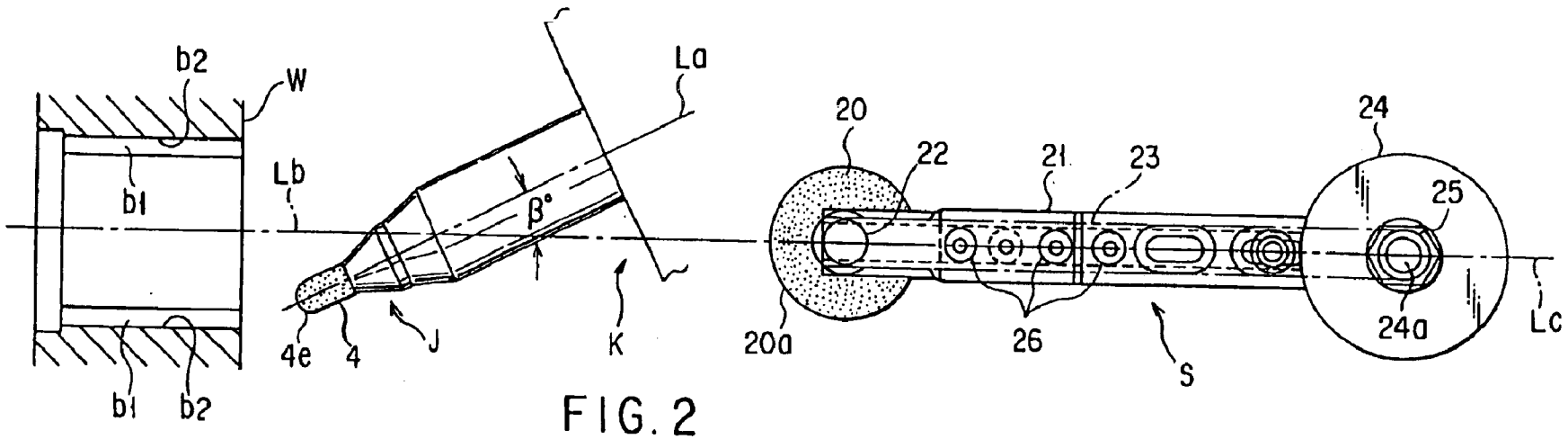
FIG. 2 is a side view showing a part of the grinding apparatus of FIG. 1 and a grinding machine for chamfering.
Figure 4B:
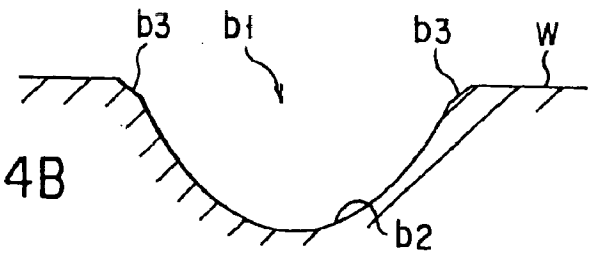
FIG. 4B is a sectional view of the groove worked by means of the grinding machine for chamfering shown in FIG. 2.

In the case where chamfer portions b3 must be formed individually on the opposite side edges of each spline ball groove b1, as shown in FIG. 4B, chamfering is carried out after a given number of grooves b1 are ground on the workpiece W. For chamfering, a grinding machine S for chamfering shown in FIG. 2 is used in place of the grinding apparatus K. Alternatively, chamfering may be carried out by means of a grinding machine for chamfering in a manner such that the workpiece W is fixed on another turntable for chamfering after it is removed from the turntable T.

The grinding machine S for chamfering shown in FIG. 2 includes a disc-shaped grindstone 20. An outer peripheral portion 20*a* of the grindstone 20 has a shape corresponding to the chamfer portions b3 of each groove b1 to be worked. The grindstone 20 is rotatably supported on the distal end portion of a holder 21. A driven pulley 22 is mounted on the grindstone 20. A drive motor 24 is provided on the other end of the holder 21. A driving pulley 25 is mounted on a rotating shaft 24*a* of the motor 24. An endless belt 23 is passed around and between the driven and driving pulleys 22 and 25. A plurality of support pulleys 26 are arranged at given spaces in the intermediate portion of the holder 21 with respect to the longitudinal direction thereof. The intermediate portion of the belt 23 is supported by means of these support pulleys 26.

An axis Lc of the grinding machine S for chamfering is in line with the axis Lb of the workpiece W. Thus, the grinding machine S is movable along the axis Lb of the workpiece W. The disc-shaped grindstone 20 in the workpiece w is movable along the axis Lb with its outer peripheral portion 20*a* in contact with opposite side edges of each spline ball groove b1. Thus, the chamfer portions b3 are formed having the inclination shown in FIG. 4B. In this chamfering operation, only a small force is needed to press the grindstone 20 against the workpiece W. Accordingly, there is no problem if the stiffness of the grinding machine S to resist reaction force from the workpiece W is low. According to this embodiment, moreover, the chamfering operation can be efficiently performed by means of the grinding machine S that includes the disc-shaped grindstone 20 after the main grinding processes for the grooves b1 are carried out by means of the high-stiffness grinding apparatus K that has the rod-shaped grindstone 4. Thus, the apparatus of this embodiment can finish the grooves b1 in a shorter time than the conventional apparatuses.

The following is a description of a method for dressing the grindstone 4. In the case of this embodiment, the so-called "through dressing" is executed in a manner such that the grindstone 4 is brought into contact with the formed rotary dresser 7 after the center of the dress groove 15 of the dresser 7 is aligned with the center of the grindstone 4. The "through dressings" mentioned herein is a method in which the distal end portion 4*e* of the grindstone 4, rotating around an axis perpendicular to the axis of rotation of the formed dresser 7, is trued and dressed by being brought into contact with the inner surface 15*a* of the dress groove 15 as it is passed through the groove 15.

The grindstone 4 is positioned with respect to the dress groove 15 in first to third positioning processes described below. The aforesaid angle β of inclination of the grindstone 4 is also maintained in these positioning processes. The cross section of the dress groove 15 is in the shape of a Gothic arch or a circular arc with a fixed curvature radius, depending on the cross section of each spline ball groove b1. The curvature radius of the distal end portion 4*e* of the grindstone 4 is smaller than that of the cross section of the dress groove 15.

Figure 7A:
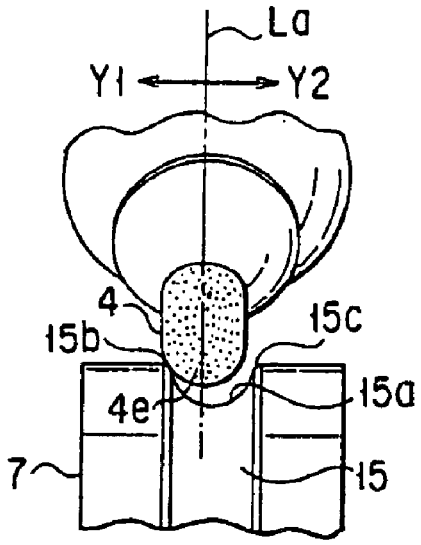
FIG. 7A is a front view partially showing the dressing apparatus in a state such that a dresser shown in FIG. 1 is moved in a first direction.

In the first positioning process, the distal end portion 4*e* of the grindstone 4 is first opposed to the inner surface 15*a* of the dress groove 15 at a short distance therefrom. Thereafter, the rotating grindstone 4 is moved relatively to the rotary dresser 7 in a first direction Y1 along the axis of the dresser 7, whereupon its distal end portion 4*e* is brought into contact with one side edge 15*b* of the dress groove 15, as shown in FIG. 7A. Vibration that is generated the moment this contact is made is transmitted to the plate spring 12 through the rotary dresser 7, collar 8, bolt 9, and ball 10. This vibration is amplified by means of the spring 12 and detected by means of the AE sensor 11. As a signal detected by the sensor 11 is applied to the input of the controller 17, the movement in the first direction Y1 is stopped, and data on a first contact position is stored in the controller 17.

Figure 7B:
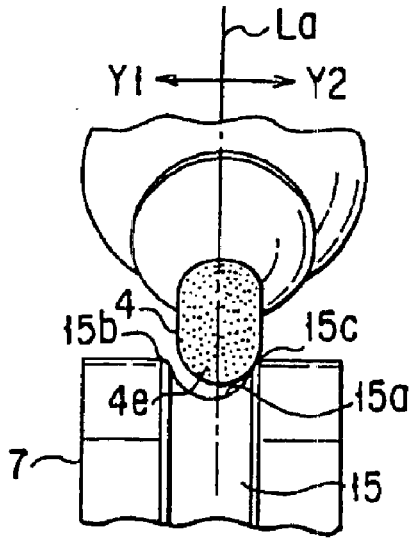
FIG. 7B is a front view partially showing the dressing apparatus in a state such that the dresser shown in FIG. 1 is moved in a second direction.
Figure 7C:
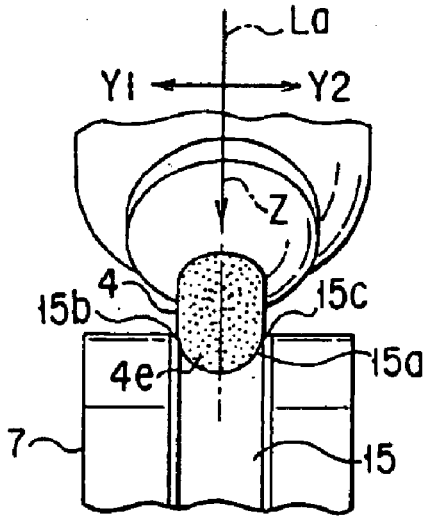
FIG. 7C is a front view partially showing the dressing apparatus in a state such that the dresser shown in FIG. 1 is in contact with the grindstone.

In the second positioning process, thereafter, the grindstone 4 is moved in a second direction Y2, whereupon the distal end portion 4*e* of the grindstone 4 is brought into contact with the other side edge 15*c* of the dress groove 15, as shown in FIG. 7B. Vibration that is generated the moment this contact is made is transmitted to the plate spring 12 through the ball 10. As the vibration amplified by means of the spring 12 is detected by means of the AE sensor 11, the movement in the second direction Y2 is stopped, and data on a second contact position is stored in the controller 17.

Then, in the third positioning process, the grindstone 4 is moved again in the first direction Y1, whereupon it is delivered to an intermediate position between the first and second contact positions. In this third positioning process, the center of the grindstone 4 is aligned with that of the dress groove 15. In a dressing process, the distal end portion 4*e* of the grindstone 4, held in the intermediate position, is moved in a Z-axis direction toward the dress groove 15, whereupon it abuts against the inner surface 15*a* of the groove 15.

In the series of positioning processes described above, the respective centers of the grindstone 4 and the dress groove 15 are aligned accurately, so that the grindstone 4 can be kept from partial dressing and shaped highly accurately with a minimum necessary depth of dressing. In this embodiment, the grindstone 4 is dressed by the dresser 7 every time the groove b1 is ground by apparatus K. In other words, grinding each spline ball groove b1 by means of the grindstone 4 and dressing the grindstone 4 are repeated alternately, so that the shape of the grindstone 4 can be maintained with high accuracy. Thus, the grinding efficiency is improved, and the life of the grindstone 4 is lengthened.

Figure 8:
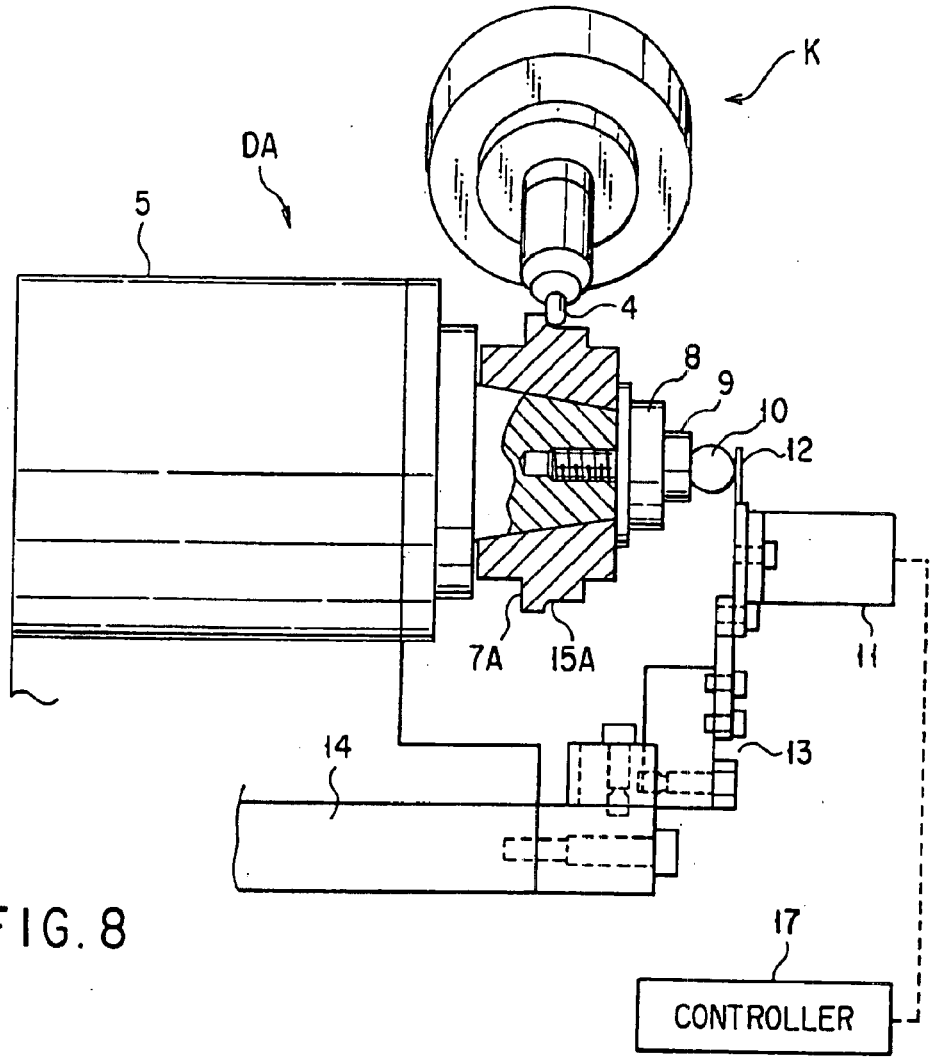
FIG. 8 is a front view, partially in section, showing a part of a grinding apparatus according to a second embodiment of the invention and a dressing apparatus.
Figure 9A:
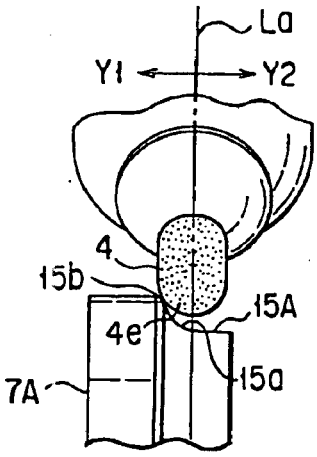
FIG. 9A is a front view partially showing the dressing apparatus in a state such that a dresser shown in FIG. 8 is moved in the first direction.
Figure 9B:
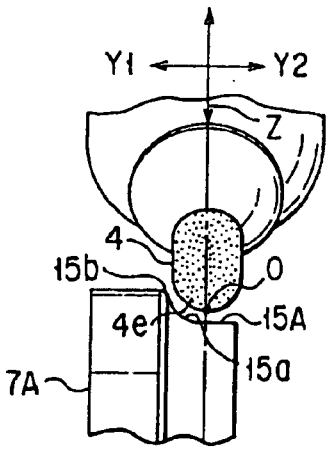
FIG. 9B is a front view partially showing the dressing apparatus in a state such that the dresser shown in FIG. 8 a is moved in the second direction.
Figure 9C:
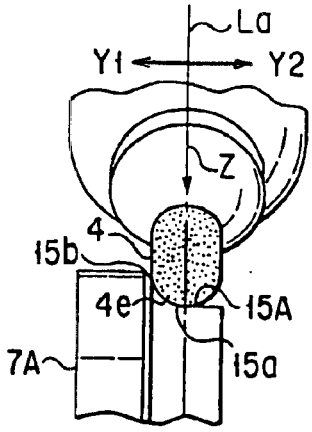
FIG. 9C is a front view partially showing the dressing apparatus in a state such that the dresser shown in FIG. 8 is in contact with the grindstone.

FIGS. 8 to 9C show a dressing apparatus DA according to a second embodiment of the invention. As shown in FIG. 9A, the cross section of a dress groove 15A of a rotary dresser 7A used in this dressing apparatus DA substantially has the shape of a quadrant. The groove 15A is continuous in the circumferential direction of the dresser 7A. As in the first embodiment shown in FIG. 1 and other drawings, the grindstone 4 is supported over the turntable T in a manner such that it is inclined at the given angle β to the axis Lb of the workpiece W. The dressing apparatus DA, like the dressing apparatus D according to the first embodiment, is designed so that the grindstone 4 can be dressed by means of the dress groove 15A as it is moved along the axis Lb of the workpiece W without changing the angle β of inclination of the grindstone 4.

First, in a first positioning process for dressing, the rotating grindstone 4 moves in the first direction Y1, whereupon its distal end portion 4*e* comes into contact with one side edge 15*b* of the dress groove 15A, as shown in FIG. 9A. Vibration that is generated by this contact is detected by means of the AE sensor 11. Thereupon, the movement in the first direction Y1 is stopped, and data on the first contact position is stored in the controller 17. In a second positioning process, thereafter, the grindstone 4, kept inclined at the angle β, is moved in the second direction Y2 toward a center point O of the dress groove 15A. In a dressing process, thereafter, the grindstone 4 is moved in a Z-axis direction or the like that is perpendicular to the first and second directions Y1 and Y2 and moved around the center point O, whereupon its whole surface is dressed.

Since the grindstone 4 is accurately positioned with respect to the dress groove 15A in this manner, partial dressing can be prevented to ensure an optimum depth of shaping, and the grindstone 4 can be dressed with high accuracy. Since the grindstone 4 is dressed every time one spline ball groove b1 is ground, as in the first embodiment, the shape of the grindstone 4 can be maintained with high accuracy. Thus, the grinding efficiency is improved, and the life of the grindstone 4 is lengthened.

Figure 10:
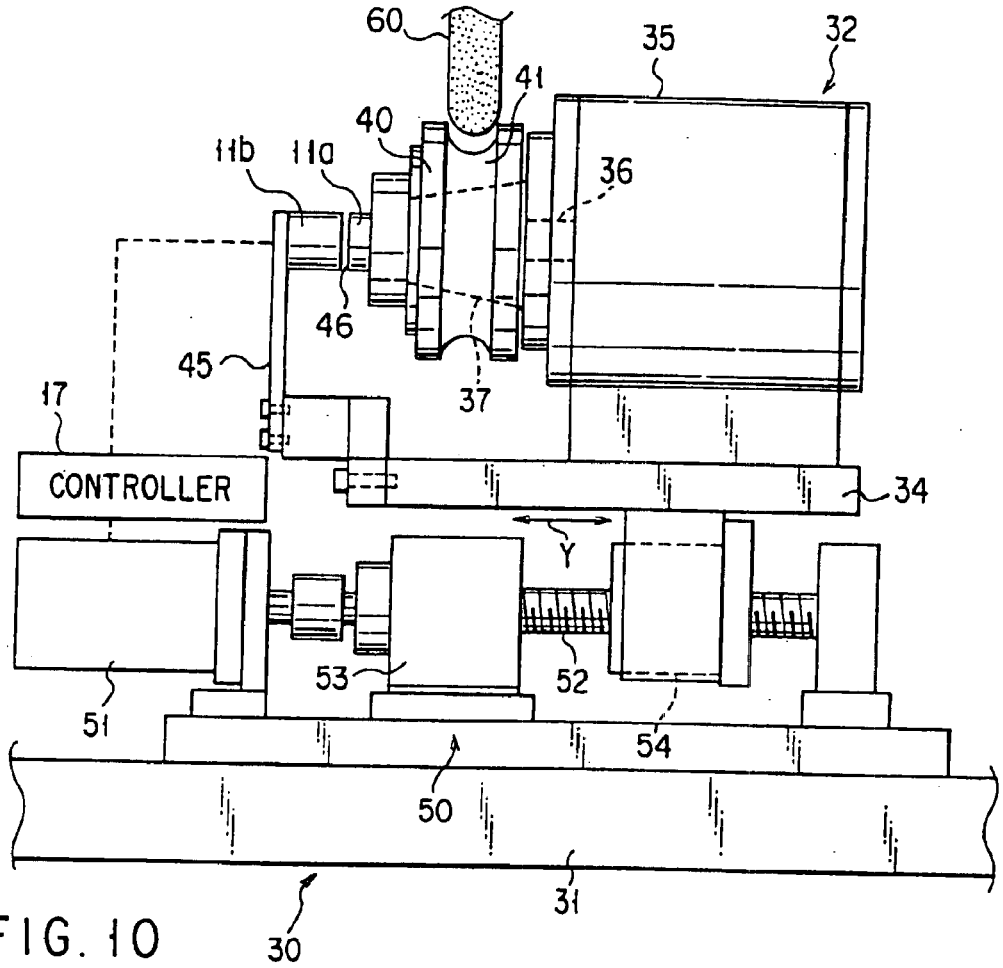
FIG. 10 is a front view of a dressing apparatus according to a third embodiment of the invention.
Figure 11A:
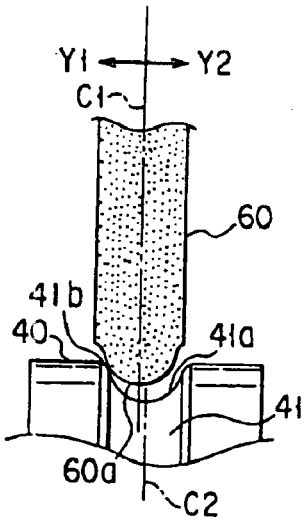
FIG. 11A is a front view partially showing the dressing apparatus in a state such that a dresser shown in FIG. 10 is moved in the first direction.
Figure 11B:
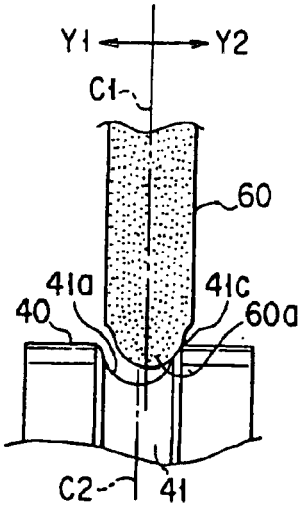
FIG. 11B is a front view partially showing the dressing apparatus in a state such that the dresser shown in FIG. 10 is moved in the second direction.
Figure 11C:
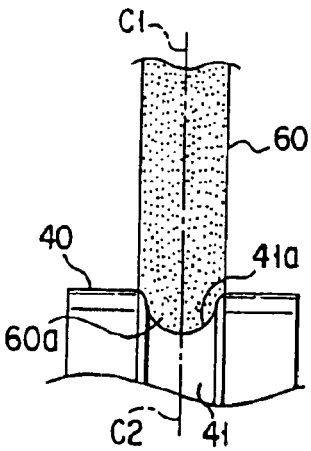
FIG. 11C is a front view partially showing the dressing apparatus in a state such that the dresser shown in FIG. 10 is in contact with the grindstone.

FIGS. 10 to 11C show a dressing apparatus 30 according to a third embodiment of the invention. This dressing apparatus 30 is provided with a dresser unit 32 that is mounted on a main table 31 of a numerically-controlled (NC) machining apparatus. The dresser unit 32 comprises a movable table 34, a rotating mechanism 35 having a motor therein, a tapered body 37 attached to an output shaft 36 of the mechanism 35, a formed rotary dresser 40 fixed on the tapered body 37. A dress groove 41 having a substantially semicircular cross section is formed on the outer peripheral surface of the dresser 40. The groove 41 is continuous in the circumferential direction of the dresser 40.

An AE sensor 11*a* is attached to an end portion of the rotary dresser 40. A receiver 11*b* is mounted by means of a sensor bracket 45 on one end portion of the movable table 34 that carries the rotating mechanism 35 thereon. The receiver 11*b* and the AE sensor 11*a* are opposed to each other with a scanty air gap 46 (e.g., about 0.5 mm) between them. A sensor such as an AE sensor may be also used as the receiver 11*b*. The receiver 11*b*, which serves also as a transmitter, is connected electrically to the controller 17 through an amplifier (not shown).

The movable table 34 can be reciprocated in the direction of arrow Y in FIG. 10 by means of a moving mechanism 50, which comprises a servomotor 51, lead screw 52, braking mechanism 53 doubling as a coupling, nut member 54, etc. The rotary dresser 40 serves to dress a grindstone 60 that is formed of CBN (cubic boron nitride material).

FIGS. 11A to 11C successively show processes for aligning the center of the rotary dresser 40 with that of the grindstone 60. In a first positioning process, the grindstone 60 is first moved to a position such that its distal end portion 60*a* is opposed to an inner surface 41*a* of the dress groove 41 at a short distance therefrom. Thereafter, the dresser 40 is moved relatively to the grindstone 60 in the first direction Y1, as shown in FIG. 11A. When the distal end portion 60*a* of the grindstone 60 comes into contact with one side edge 41*b* of the dress groove 41, its vibration is detected by means of the AE sensor 11*a*. The sensor 11*a* delivers an output based on a signal detected thereby to the receiver 11*b*. The output of the AE sensor 11*a* is propagated through the air gap 46 to the receiver 11*b* and then applied to the input of the controller 17. As this is done, the controller 17 generates a signal to stop the table 34. According to the signal propagation system of this type, the noise level is low, and the gain can be set at a high level. It is possible, therefore, to detect even fine vibration that is generated when the grindstone 60 and the rotary dresser 40 are only in point contact with each other. A first contact position (Y1-direction coordinate position at which the table 34 is stopped) detected in this first positioning process is stored in the controller 17.

Then, in a second positioning process, the rotary dresser 40 is moved relatively to the grindstone 60 in the second direction Y2. Vibration that is generated the moment the grindstone 60 touches the other side edge 41*c* of the dress groove 41, as shown in FIG. 11B, is detected by means of the AE sensor 11*a*. As the output of the sensor 11*a* is propagated to the receiver 11*b*, moreover, data on a second contact position is applied to the input of the controller 17. In this case also, the table 34 is stopped as the braking mechanism 53 is actuated.

In a third positioning process, thereafter, the dresser 40 moves again in the first direction Y1, whereupon a center C2 of the dresser 40 is aligned with a center point between the first and second contact positions, that is, a center C1 of the grindstone 60, with respect to the Y coordinate axis. Then, in a dressing process, the grindstone 60 moves toward the dress groove 41, as shown in FIG. 11C, and through dressing is carried out.

In the dressing apparatus 30 according to this embodiment, the AE sensor 11*a* and the receiver 11*b* of the noncontact type, which are opposed to each other with the air gap 46 between them, are used as means for detecting the contact between the rotary dresser 40 and the grindstone 60. Since the sensor 11*a* and the receiver 11*b* propagate an AE signal without touching each other, the noise level is low, so that the gain level can be raised. Accordingly, slight contact between the small-diameter grindstone and the dresser can be detected. In the conventional apparatuses, a liquid is used to propagate signals from the rotary dresser to the sensor on the table. In the dressing apparatus D according to the first embodiment, the ball 10 and the plate spring 12 are brought into contact with each other. However, these requirements can be canceled by the use of the AE sensor 11*a* and the receiver 11*b* of the noncontact type.

In the first to third positioning processes described above, the moving mechanism 50 receives a stop signal and then stops the table 34 by means of a skip function with an adjustable-speed-time constant of zero. Since this operation is subject to a time lag, the table 34 stops after it slightly moves for a distance corresponding to a table flow based on a position loop gain and a table feed rate as parameters. If this flow is excessive, the shape of the grindstone 60 is ruined, and the deformation of the grindstone 60 cannot be corrected in one cycle of the dressing process. The flow can be lessened by increasing the position loop gain or lowering the table feed rate. If the table feed rate is lowered too much, the necessary cycle time for dressing lengthens inevitably.

In the dressing apparatus 30 according to this embodiment, a target value of the flow rate is set at 1 to 2 $\mu$m. With use of the flow value, the grindstone 60 can be shaped in one cycle of the dressing process even if it is somewhat flawed. Since the uniaxial dresser unit 32 according to this embodiment can be made compact, high natural axial frequency can be obtained by rationalizing the stiffness of the lead screw 52, a supporting portion for the screw 52, and the coupling.

If the natural axial frequency of the table 34 is low, the table 34 is rendered uncontrollable by vibration when the speed loop gain is enhanced. In the case of the dresser unit 32 according to this embodiment, the target position loop gain is 70 $sec^{-1}$, so that the cutoff frequency of the speed loop gain is at about 100 Hz. Accordingly the natural axial frequency of the table is expected to be 100 Hz or more. If the target position loop gain is 70 $sec^{-1}$, the cutoff frequency of the position loop gain is at $70/(2\pi)=11.1$ Hz. In this case, the cutoff frequency of the speed loop gain is at about 100 Hz. Since this region is not expected to involve a mechanical. resonance region on the table side, the table requires a natural axial frequency of 100 Hz or more.

Figure 12:
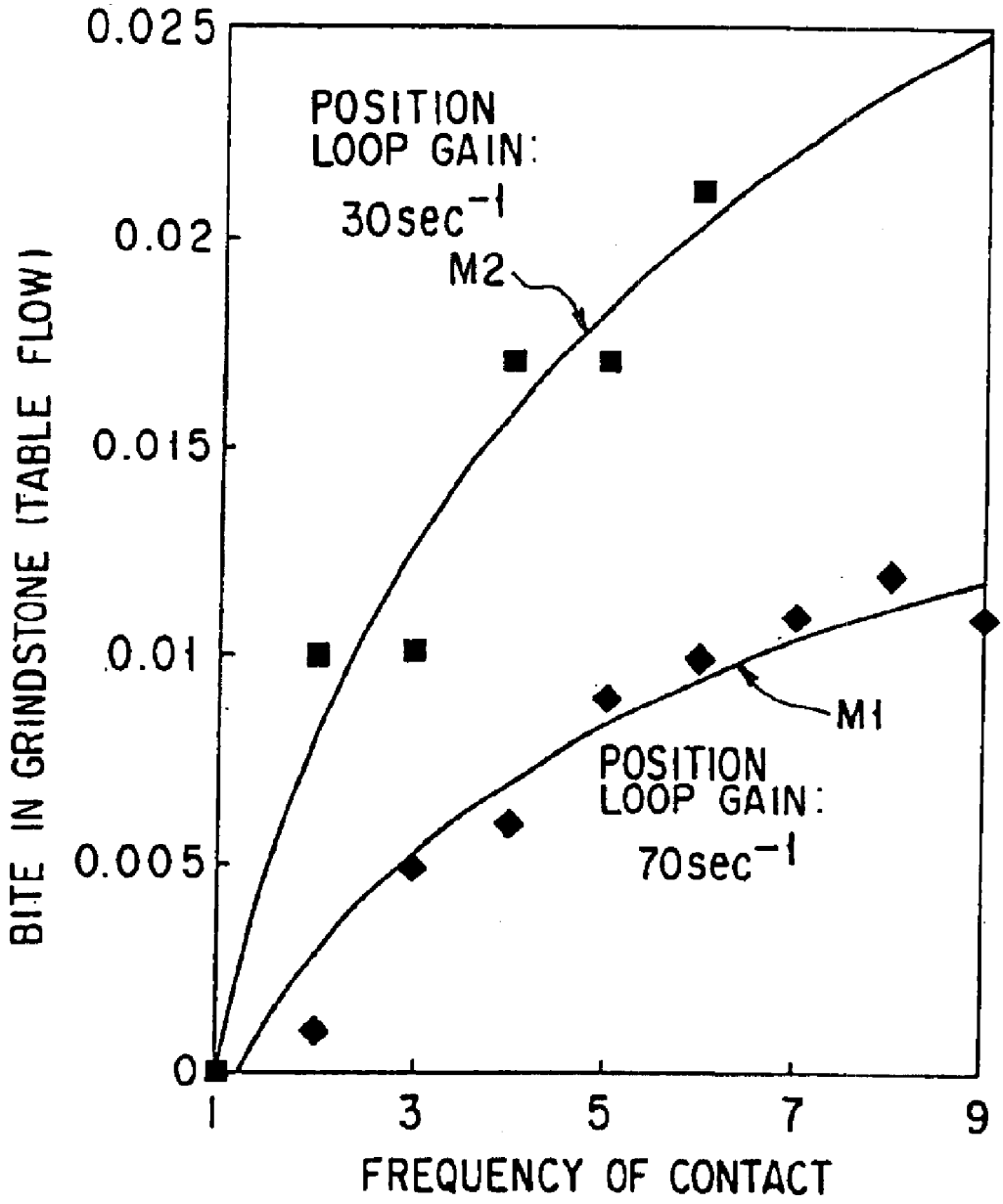
FIG. 12 is a diagram showing flows of a grindstone for position loop gains of 30 $sec^{-1}$ and 70 $sec^{-1}$, in the dressing apparatus shown in FIG. 10.
Figure 13:
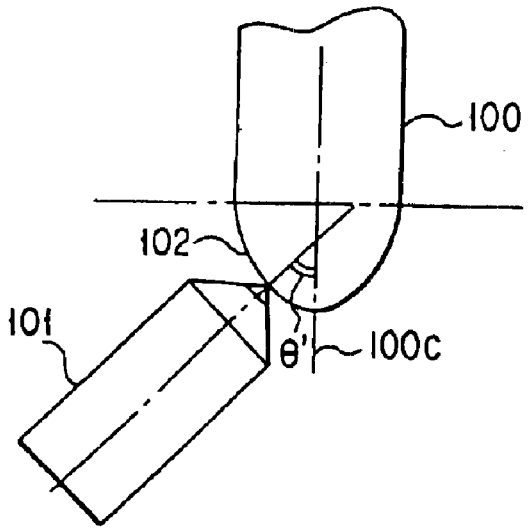
FIG. 13 (PRIOR ART)
FIG. 13 is a front view showing a part of a conventional dressing apparatus.
Figure 14:
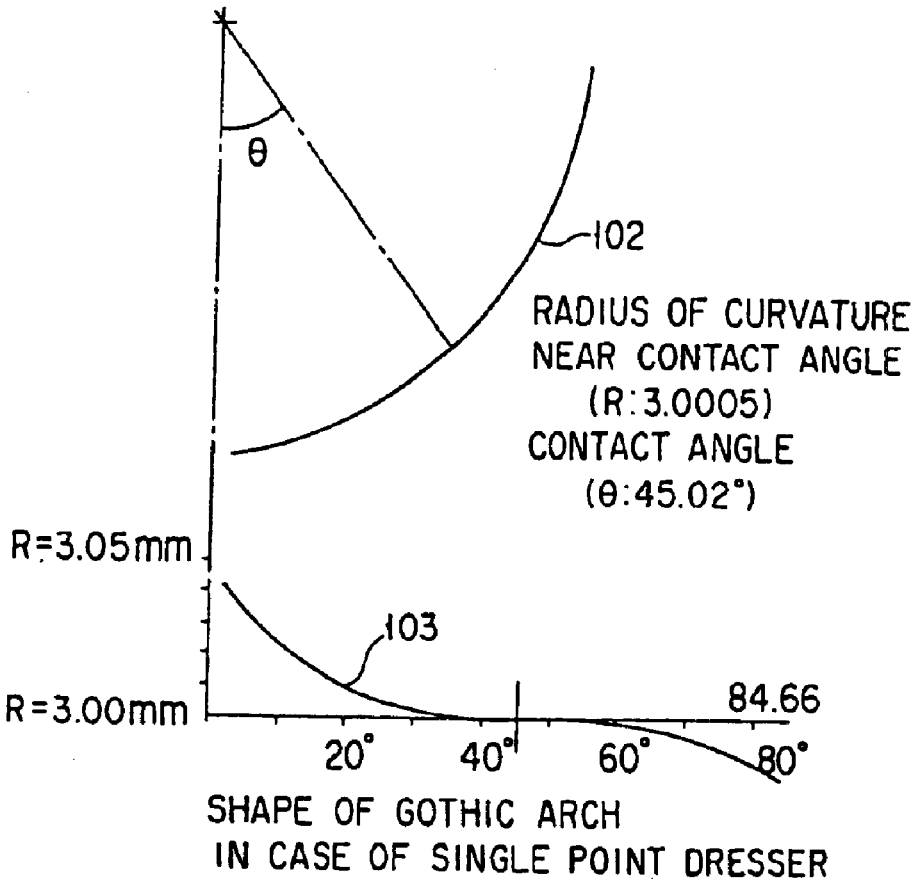
FIG. 14 (PRIOR ART)
FIG. 14 is a diagram showing undulation of a groove worked by means of the conventional apparatus shown in FIG. 13.

FIG. 12 shows differences in flow that are attributable to differences in the set value of the position loop gain. These differences are ones that are obtained when the grindstone 60 is brought into contact with the rotary dresser 40 at a feed rate of 3 mm/min. In other words, these are differences between total flows obtained when the grindstone is caused to touch the dresser several times after one cycle of dressing is finished. In FIG. 12, both of segments M1 and M2 are curves of secondary degree because the contact area of the grindstone 60 on the dresser 40 increases (or the contact mode changes from point contact into linear contact) as the frequency of contact increases. The flow for the case where the position loop gain is 70 $sec^{-1}$ ranges from 1 to 2 $\mu$m for first and second cycles of contact. If the position loop gain is 30 $sec^{-1}$, on the other hand, the flow is as large as about 10 $\mu$m.

For the reason described above, the dressing apparatus 30 according to this embodiment is designed so that the natural axial frequency of the table is 100 Hz or more. Thus, the position loop gain can be increased to 70 $sec^{-1}$, and the flow can be restricted to 2 $\mu$m to less. The dresser unit 32 according to this embodiment is mounted on the uniaxial movable table 34 that is separate from the main table 31. Since the movable table 34 is compact, the natural axial frequency of the table as a simple can be enhanced, so that the positioning accuracy for the table 34 is improved.

In the dressing apparatus 30 according to this embodiment, moreover, the position loop gain is set between 50 $sec^{-1}$and 100 $sec^{-1}$, so that the time lag with which the table 34 stops after the detected contact signal is applied to the input of the controller 17 is further lessened. In the case where the respective centers of the grindstone 60 and the formed dresser 40 are aligned as in the case of the dressing apparatus 30, it is advisable to adjust the feed rate for the table 34 to 3 mm/min or more in consideration of the necessary cycle time for dressing. In consideration of modification for each cycle of the dressing process, moreover, the bite of the dresser 40 in the grindstone 60 based on the table flow should be adjusted to 5 $\mu$m or less. To meet these requirements (table feed rate of 3 mm/min and flow of 5 $\mu$m or less), the position loop gain must set at about 50 $sec^{-1}$ or more, as seen from FIG. 12. Practically, however, the position loop gain cannot be increased to 100 $sec^{-1}$.

Although the grindstone 60 shown in FIGS. 11A to 11C is intended for outer surface grinding, the dressing apparatus 30 according to this embodiment may be also applied to a pencil-type grindstone as well as to the grindstone 4 for inner surface grinding shown in FIG. 1. According to each of the foregoing embodiments, the grindstone is moved with respect to the fixed workpiece in the grinding processes. However, the present invention may be arranged so that the workpiece is moved with respect to the grindstone.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A method for dressing a grindstone used in a grinding apparatus by means of a rotary dresser having a dress groove, comprising:

a first positioning process for relatively moving the grindstone in a first direction along the axis of the rotary dresser from a position in which the grindstone faces an inner surface of the dress groove, detecting a contact position reached the moment the grindstone touches one side edge of the dress groove, and stopping the movement;

a second positioning process for moving the grindstone for a given distance in a second direction along the axis, the second positioning process directly following the first positioning process; and a dressing process for moving the grindstone toward the inner surface of the dress groove in a direction perpendicular to the axis, thereby bringing a distal end portion of the grindstone into contact with the inner surface of the dress groove, the dressing process directly following the second positioning process.

2. A dressing method for dressing a CBN grindstone by means of a formed rotary dresser, comprising:

a process for detecting contact between the rotary dresser and the grindstone, thereby detecting dislocation between the dresser and the grindstone;

a process for correcting the dislocation; and a process for bringing the grindstone into contact with the rotary dresser, thereby dressing the grindstone.

3. A dressing method according to claim 2, further comprising a process for bringing the grindstone successfully into contact with one side edge and the other side edge of a dress groove in a manner such that the grindstone is dislocated for a given distance from the dresser, detecting the contact between the grindstone and the side edges, and storing first and second coordinates for the contact, and a process for concluding a median between the first and second coordinates as a central position coordinate for the dresser.

* * * * *